US007169020B2

(12) United States Patent
Kitamura et al.

(10) Patent No.: US 7,169,020 B2
(45) Date of Patent: Jan. 30, 2007

(54) GRINDING JIG SET AND GRINDING METHOD

(75) Inventors: Kazumasa Kitamura, Ichinomiya (JP); Katsuyuki Tsuneoka, Nagoya (JP); Tomoki Nagae, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 11/264,944

(22) Filed: Nov. 2, 2005

(65) Prior Publication Data

US 2006/0099887 A1 May 11, 2006

(30) Foreign Application Priority Data

Nov. 10, 2004 (JP) ..... 2004-326927

(51) Int. Cl.
*B24B 49/00* (2006.01)

(52) U.S. Cl. ..... 451/11; 451/12; 451/386; 451/391; 451/914; 269/900; 269/45

(58) Field of Classification Search ..... 451/11, 451/12, 336, 339, 386, 391, 914, 388; 269/21, 269/309, 311, 900, 38, 44, 45
See application file for complete search history.

(56) References Cited

U.S. PATENT DOCUMENTS

| | | | | |
|---|---|---|---|---|
| 1,528,993 | A * | 3/1925 | Samuel | 451/276 |
| 2,817,193 | A * | 12/1957 | Unzicker | 451/365 |
| 2,988,861 | A * | 6/1961 | Vanstrom | 451/365 |
| 3,834,087 | A * | 9/1974 | Dunn | 451/401 |
| 3,868,794 | A * | 3/1975 | Zitkus | 451/41 |
| 4,098,032 | A * | 7/1978 | Olbert | 451/57 |
| 4,669,416 | A * | 6/1987 | Delgado et al. | 118/503 |
| 6,047,958 | A * | 4/2000 | Marinkovic | 269/43 |
| 6,386,191 | B1 * | 5/2002 | Yoshimura et al. | 125/35 |
| 2004/0113345 | A1 * | 6/2004 | Montague et al. | 269/309 |

FOREIGN PATENT DOCUMENTS

| | | |
|---|---|---|
| DE | 22 29 719 | 1/1974 |

* cited by examiner

*Primary Examiner*—Eileen P. Morgan
(74) *Attorney, Agent, or Firm*—Burr & Brown

(57) ABSTRACT

A grinding jig set comprising a combination of several jig units and a method for grinding a number of objects are provided. The method comprises a series of steps from arranging the objects to be ground on a grinding jig (a master plate) through removing the ground objects from the grinding jig after completion of grinding process, smoothly and precisely without damaging a number of the objects to be ground and without altering the arrangement pattern of the objects to be ground from the start through the end of the series of steps. The jig set for grinding comprises a set of jig units used for a series of processing from allocation of objects to be ground on a grinding jig through removing the ground objects from the grinding jig after the grinding operation. The jig units include a small allocation tray, a dividing tray which can transfer the objects to be ground retained in the small allocation tray from a starting tray to the small allocation tray, a dividing plate which can arrange the objects to be ground laid on the small allocation tray onto the surface of a grinding jig in the transferred state, and a removing tray onto which the ground objects removed from the surface of the grinding jig by a specified removing process can be relocated in the transferred state and divided into partial patterns.

17 Claims, 9 Drawing Sheets

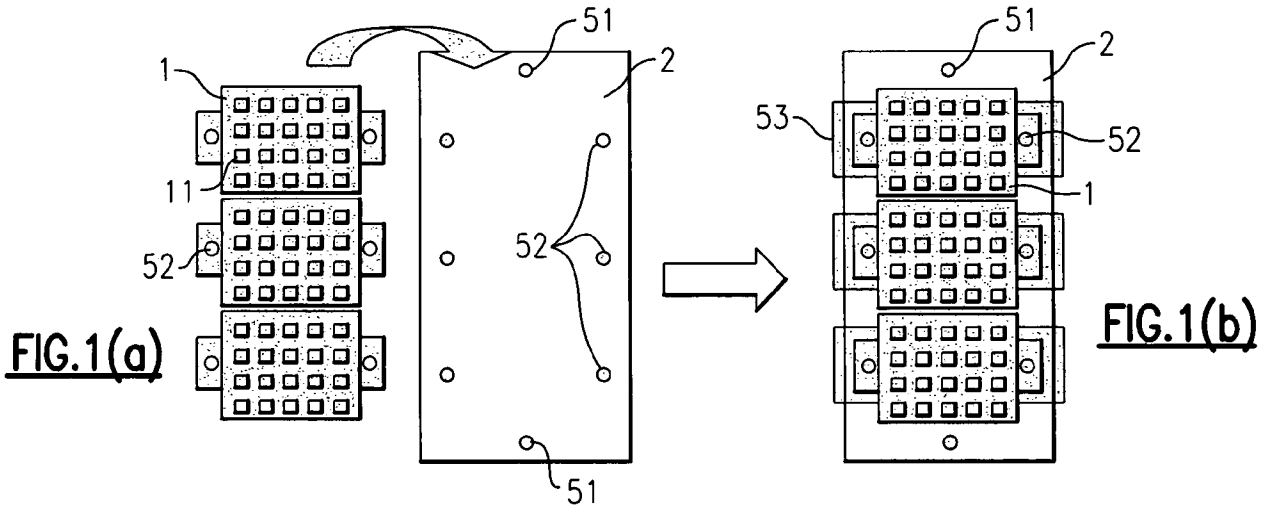
FIG.1(a)
FIG.1(b)
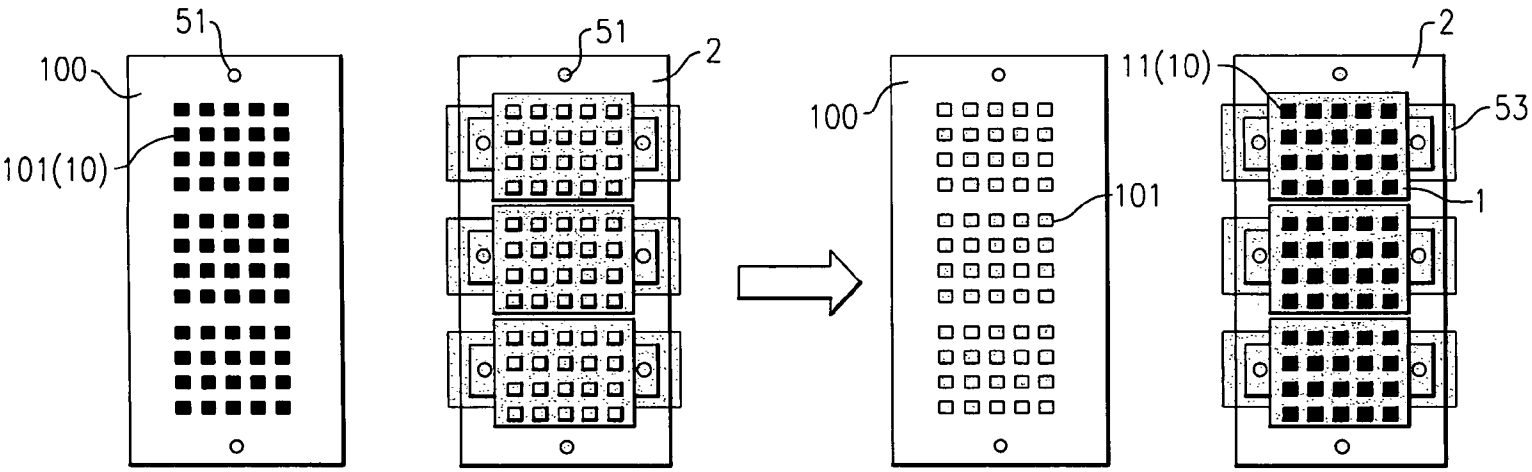
FIG.2(a)
FIG.2(b)

500
450
400
201
200
300
10
A PORTION

GRINDING JIG SET AND GRINDING METHOD

BACKGROUND OF THE INVENTION

1. Field of the Invention

The present invention relates to a grinding jig set and a method for grinding a number of objects. More particularly, the present invention relates to a grinding jig set comprising a combination of several jig units and a method for grinding a number of objects such as ceramic electronic parts, the method comprising a series of steps from arranging the objects to be ground on a grinding jig (a master plate) through removing the ground objects from the grinding jig after completion of grinding process, smoothly and precisely without damaging a number of the objects to be ground and without altering the arrangement pattern of these objects from the start through the end of the series of steps.

2. Background Art

A special process is required for grinding (lapping, for example) a number of objects (such as ceramic electronic parts, for example) not only to prevent variations and damage in the objects to be ground due to difference in locations during the grinding operation, but also to secure convenience of various steps after grinding (such as separate control of the ground objects, for example). Such a process comprises aligning the objects to be ground on an allocation tray in a specified arrangement pattern so that one object does not come in contact with the others, transferring by a manual operation the objects to be ground from the allocation tray to the adhesive surface of an adhesive tape in an arrangement pattern suitable for grinding operation, grinding the objects to be ground on a grinding jig (a master plate) onto which these objects have been transferred from the adhesive plane of the tape, removing the ground objects from the grinding jig (master plate), and relocating a number of ground objects on a removing tray according to the same arrangement pattern as in the allocation tray by a manual operation.

However, when a number of objects to be ground, particularly those having a small mechanically weak beam-like projections, such as a great number of small electronic parts made from ceramics, are arranged on the allocation tray by a manual operation, the objects may be damaged during an operation such as picking-up or handling with hard tools such as tweezers. In addition, when an object to be ground has a complicated shape (such as a U-shape) which may easily become entangled with other objects of the same type, these objects may be damaged by entanglement or rubbing against each other. Furthermore, when the objects to be ground adhering to an adhesive tape are transferred onto the grinding jig, the objects may crack or be broken during the operation of the removing from the adhesive tape, thereby decreasing the product quality. In addition, manually locating a number of the objects to be ground onto an allocation tray while maintaining the arrangement pattern and transferring them onto an adhesive tape are extremely time-consuming, inefficient, and complicated operations.

The present invention has been achieved to solve the above problems and has an object of providing a grinding jig set comprising a combination of several jig units and a method for grinding a number of objects such as ceramic electronic parts, the method comprising a series of steps from arranging the objects to be ground on a grinding jig (a master plate) through removing the ground objects from the grinding jig after completion of grinding process, smoothly and precisely without damaging a number of the objects to be ground and without altering the arrangement pattern of the objects to be ground from the start through the end of the series of steps.

SUMMARY OF THE INVENTION

Specifically, the present invention provides the following grinding jig set and grinding method.

(1) A jig set for grinding comprising a set of jig units used for a series of processing from allocation of objects to be ground on a grinding jig (a master plate) through removing the ground objects from the grinding jig after the grinding operation, wherein the jig units comprise: small allocation trays capable of mounting objects to be ground thereon divided in specified partial patterns, after receiving transfer thereof from the surface of a starting tray, on which the objects to be ground are aligned in a specified mounting pattern; a dividing tray having a configuration corresponding to the starting tray, which is capable of holding the small allocation trays previously arranged so that the entire aggregation of said partial patterns may be the same as said mounting pattern, when said objects to be ground are transferred to the small allocation trays, and by which said objects to be ground can be transferred from the starting tray to the small allocation trays, while retaining the state of the small allocation trays held therein; a dividing plate which is capable of having the small allocation trays mounted on the surface thereof in the specified arrangement pattern after receiving transfer of the small allocation trays from the dividing tray in which the small allocation trays are retained, and transferring the objects to be ground laid on the small allocation trays onto the surface of the grinding jig in the transferred state (i.e. while retaining their arrangement as is); and small removing trays onto which the ground objects are relocated from the surface of the grinding jig in the transferred state and divided into the above-described partial patterns, after completing the grinding of the objects arranged on the grinding jig in the transferred state and after these objects, which were allocated on the surface of the above-described dividing plate in the above-described allocation patterns, have been removed from the surface of the grinding jig by means of a prescribed removing treatment; the combination of the jig units ensuring that all of the objects to be ground are allocated onto the grinding jig at one time without coming into contact with each other and that the ground objects after completion of the grinding operation are removed from the grinding jig.

(2) The jig set according to (1), wherein the dividing tray and starting tray are provided with a first positioning means that can determine the mutual positions when the objects to be ground are transferred from the starting tray to the small allocation tray.

(3) The jig set according to (1) or (2), wherein the dividing tray and the small allocation trays are provided with a second positioning means that can determine the mutual positions when the small allocation trays are arranged and retained on the dividing tray.

(4) The jig set according to any of (1) to (3), wherein the dividing plate and the small allocation tray are provided with a third positioning means that can determine the mutual positions when the small allocation trays are arranged and retained on the dividing plate.

(5) The jig set according to any of (1) to (4), wherein the dividing plate and the grinding jig are provided with a fourth positioning means that can determine the mutual positions when the objects to be ground laid on the small allocation trays, which are arranged on the surface of the dividing plate, are located on the surface of the grinding jig in a transferred state.

(6) The jig set according to any of (1) to (5), wherein the dividing plate and the small removing tray are provided with a fifth positioning means that can determine the mutual positions when the small removing trays are arranged and retained on the dividing plate.

(7) The jig set according to any of (1) to (6), wherein the small removing tray is provided with pockets for holding the objects to be ground and has through-holes communicating with the outside formed in the bottom of the pockets.

(8) The jig set according to any of (1) to (7), wherein the small allocation tray and the small removing tray are provided with pockets for holding the objects to be ground and the holding area of the pockets in the small removing tray is larger than the holding area of the pockets in the small allocation tray.

(9) A grinding method comprising locating objects to be ground on a grinding jig (a master plate), grinding the objects, and removing the ground objects from the grinding jig after grinding operation, the method further comprising providing objects to be ground laid on the surface of a starting tray aligned in a specified pattern, providing small allocation trays which can mount the objects to be ground thereon after receiving transfer thereof from the surface of the starting tray in a state divided in specified partial patterns, providing a dividing tray having a configuration corresponding to the starting tray, placing the small allocation trays on the dividing tray by aligning the small allocation trays in a manner so that the entire pattern aggregating the partial patterns may be the mounting pattern, and transferring the objects to be ground from the starting tray to the small allocation trays; transferring the small allocation trays held on the dividing tray to the surface of a dividing plate in a predetermined arrangement pattern; relocating the objects to be ground from the small allocation trays to the surface of the grinding jig in a transferred state in order to grind the objects relocated onto the surface of the grinding jig in a transferred state; after completion of the grinding, removing the ground objects from the surface of the grinding jig by means of a prescribed removing treatment, and transferring the ground objects to the small removing trays located in the arrangement pattern in a transferred state, divided into the partial patterns.

(10) The method according to (9), wherein when the objects to be ground placed on the small allocation trays are arranged on the surface of the grinding jig in a transferred state, the objects to be ground are secured on the surface of the grinding jig in the transferred state using an adhesive.

(11) The method according to (10), wherein when an adhesive is previously applied to the surface of the grinding jig and the objects to be ground are secured to that surface with the adhesive in the transferred state, the objects to be ground are secured by a press operation while causing an elastic material with specific hardness to be present on the surface of the adhesive.

(12) The method according to any of (9) to (11), wherein the small removing tray is provided with pockets for holding the objects to be ground and has through-holes communicating with the outside formed in the bottom of the pockets.

(13) The method according to any of (9) to (12), wherein a small allocation tray and small removing tray having pockets for holding the objects to be ground are used and the holding area of the pockets in the small removing tray is larger than the holding area of the pockets in the small allocation tray.

(14) The method according to any of (9) to (13), wherein the dividing tray and starting tray are provided with a first positioning means that can determine the mutual positions when the objects to be ground are transferred from the starting tray to the small allocation tray.

(15) The method according to any of (9) to (14), wherein the dividing tray and the small allocation tray are provided with a second positioning means that can determine the mutual positions when the small allocation trays are arranged and retained on the dividing tray.

(16) The method according to any of (9) to (15), wherein the dividing plate and the small allocation tray are provided with a third positioning means that can determine the mutual positions when the small allocation trays are arranged on the surface of the dividing plate.

(17) The method according to any of (9) to (16), wherein the dividing plate and the small removing tray are provided with a fourth positioning means that can determine the mutual positions when the small removing trays are arranged on the surface of the dividing plate.

(18) A grinding method comprising locating objects to be ground on a grinding jig (a master plate), grinding the objects, and removing the ground objects from the grinding jig after the grinding operation, the method further comprising, previously applying an adhesive to the surface of the grinding jig and securing the objects to be ground on the surface of the grinding jig by positioning them to penetrate the adhesive to the extent that one half or more of their length is embedded in the adhesive.

(19) The method according to (18), wherein, when an adhesive is previously applied to the surface of the grinding jig and the objects to be ground are secured to that surface by positioning them so that the objects penetrate the adhesive to the extent that one half or more of their length is embedded in the adhesive, a press operation is carried out by causing an elastic material with specific hardness to be present on the surface of the adhesive to reduce the embedding height of the objects to be ground in the adhesive.

(20) A grinding method comprising locating objects to be ground on a grinding jig (a master plate), grinding the objects, and removing the ground objects from the grinding jig after the grinding operation, the method further comprising, previously applying an adhesive to the surface of the grinding jig and securing the objects to be ground, together with a spot spacer with a thickness greater than the thickness of the objects to be ground, on the surface of the grinding jig by positioning them to penetrate the adhesive to the extent that one half or more of their length is embedded in the adhesive.

(21) The method according to (20), wherein the spot spacer of which the surface coming in contact with the plate is chamfered is used.

(22) The method according to (20) or (21), wherein the spot spacer is made of a ceramic material.

(23) The method according to any of (1) to (22), wherein the object to be ground contains mechanically weak parts.

According to the present invention, a grinding jig set comprising a combination of several jig units and a method for grinding a number of objects such as ceramic electronic parts are provided. The method comprises a series of steps from arranging the objects to be ground on a grinding jig (a master plate) through removing the ground objects from the grinding jig after completion of grinding process, smoothly and precisely without damaging a number of the objects to be ground and without altering the arrangement pattern of the objects to be ground from the start through the end of the series of steps.

BRIEF DESCRIPTION OF THE DRAWINGS

FIG. 1(*a*) (*b*) are diagrams for schematically illustrating a method for arranging small allocation trays on the surface of a dividing tray, in which FIG. 1(*a*) shows the state before arrangement and FIG. 1(*b*) shows the state after arrangement.

FIG. 2(*a*) (*b*) are diagrams for schematically illustrating a method for transferring objects to be ground to transfer pockets of the small allocation tray disposed on the surface of a dividing tray, in which FIG. 2(*a*) shows the state before transfer and FIG. 2(*b*) shows the state after transfer.

DETAILED DESCRIPTION OF THE INVENTION AND PREFERRED EMBODIMENTS

Figure 3B:
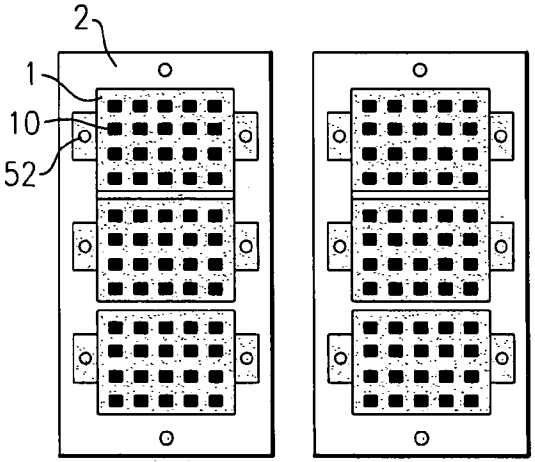
FIG. 3(*a*)(*b*) are diagrams for schematically illustrating a method of processing the small allocation trays, on which the objects to be ground have been transferred, before arrangement on the surface of a dividing plate, in which FIG. 3(*a*) shows the state before processing and FIG. 3(*b*) shows the state after processing.

The jig set for the grinding process of the present invention is a set of jig units used for a series of processing from allocation of objects to be ground on a grinding jig (a master plate) through removing the ground objects from the grinding jig after grinding operation. Specifically, the jig of the present invention comprises a small allocation tray, a dividing tray, a dividing plate, and a small removing tray as jig units. A preferred embodiment of the present invention will now be explained in detail by way of the constitution and method of using each jig unit with reference to the drawings.

As shown in FIG. 1(*a*) and FIG. 1(*b*), a small allocation tray 1 is configured to mount objects to be ground 10 thereon, wherein the objects to be ground being mounted on mounting pockets 101 (see FIG. 2(*a*)) formed on the surface of a starting tray 100 (see FIG. 2(*a*)) aligned in a specified pattern, are transferred from the mounting pockets 101 of the starting tray 100 to transfer pockets 11, divided into specified partial patterns, the transfer pockets 11 being formed on the surface of the small allocation tray 1 in a pattern corresponding to the partial patterns of the to-be-ground objects 10. FIG. 1(*a*) shows an example using three small allocation trays. Although there are no specific limitations to the material of the small allocation trays, polycarbonate can be given as a preferable example.

As shown in FIG. 1(*a*) and FIG. 1(*b*), a dividing tray 2 has a configuration corresponding to the starting tray 100, whereby the dividing tray 2 can retain the small allocation trays 1 when the objects to be ground 10 are transferred to the transfer pockets 11 on the small allocation tray 1, arranged in the manner such that the entire pattern which is an aggregation of the above-described partial patterns may be the mounting pattern in the starting tray 100 (see FIG. 1 (*a*)). The dividing tray 2 can thus transfer the objects to be ground 10 from the start tray 100 to the small allocation tray 1, while retaining the small allocation trays 1. Although there are no specific limitations to the material of the dividing tray 2, aluminum, stainless steel, and the like can be given as preferable examples.

As shown in FIG. 1(*a*) and FIG. 1(*b*), the dividing tray 2 and the small allocation tray 1 are preferably provided with a second positioning means (a second positioning pin or hole) 52 for determining mutual positions when the small allocation trays 1 are arranged on the dividing-tray 2. After positioning, the two members are secured with three first clips 53.

As shown in FIG. 2(*a*) and FIG. 2(*b*), when the objects to be ground 10 mounted on mounting pockets 101 on the surface of the starting tray 100 aligned in a specified pattern are transferred from the starting tray 100 to the transfer pockets 11 formed on the surface of the small allocation tray 1 in a pattern corresponding to the partial pattern of the objects to be ground 10, the starting tray 100 on which the objects to be ground 10 are mounted may be superposed on the dividing tray 2 in which small allocation trays 1 are retained. FIG. 2(*a*) shows the state before superposing, whereas FIG. 2(*b*) shows after superposing. In FIG. 2(*b*), the objects to be ground 10 laid on the surface of the starting tray 100 are transferred to the transfer pockets 11 of the small allocation tray 1. Only empty mounting pockets 101 are shown on the surface of the starting tray 100.

As shown in FIG. 2(*a*), the dividing tray 2 and the starting tray 100 are preferably provided with a first positioning means (a first positioning pin or hole) 51 for determining the mutual positions when the objects to be ground 10 are transferred from the mounting pockets 101 of the starting tray 100 to the transfer pockets 11 of the small allocation tray 1.

Figure 3A:
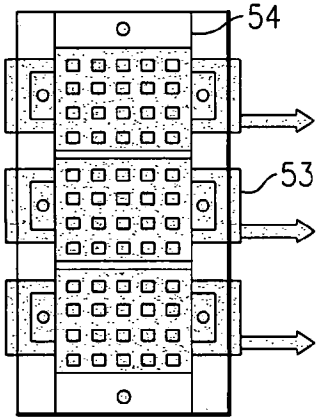
Figure 4B:
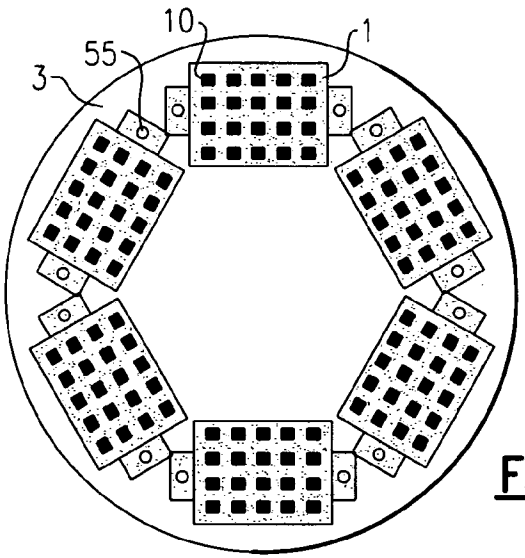
FIG. 4(*a*) (*b*) are diagrams for schematically illustrating a method of arranging the small allocation trays, on which the objects to be ground have been transferred, on the surface of a dividing plate, in which FIG. 4(*a*) shows the state before arrangement and FIG. 4(*b*) shows the state after arrangement.
Figure 4A:
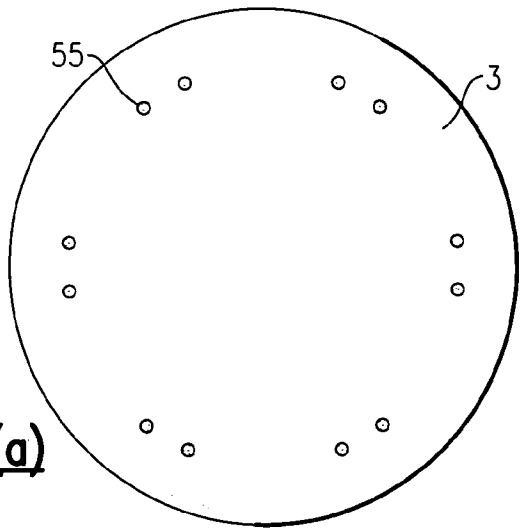

As shown in FIG. 3(*a*) and FIG. 3(*b*), to transfer the small allocation trays 1 onto the surface of the dividing plate 3 (see FIG. 4(*a*)) in a predetermined allocation pattern, a first protection cover 54 is laid over a combined body of the small allocation trays 1, with the transfer pockets 11 into which the objects to be ground 10 have been transferred, and the dividing tray 2. Then, the first clips 53 are removed and the small allocation trays 1 with the transfer pockets 11 into which the objects to be ground 10 have been transferred are transferred onto the surface of the later-described dividing plate 3 in the predetermined allocation pattern. FIG. 3(*b*) and the later-discussed FIG. 4(*b*) show the case in which six small allocation trays are transferred.

As shown in FIG. 4(*a*) and FIG. 4(*b*), the dividing plate 3 is configured to have the small allocation trays 1, which have been transferred from the dividing tray 2 shown in FIG. 3(*b*), mounted onto the surface thereof in the predetermined arrangement pattern and, at the same time, to have the objects to be ground 10 laid on the small allocation trays 1 transferred and located onto the surface of the grinding jig in a transferred state as discussed later. Although there are no specific limitations to the material of the dividing plate 3, aluminum, stainless steel, and the like can be given as preferable examples.

Figure 5B:
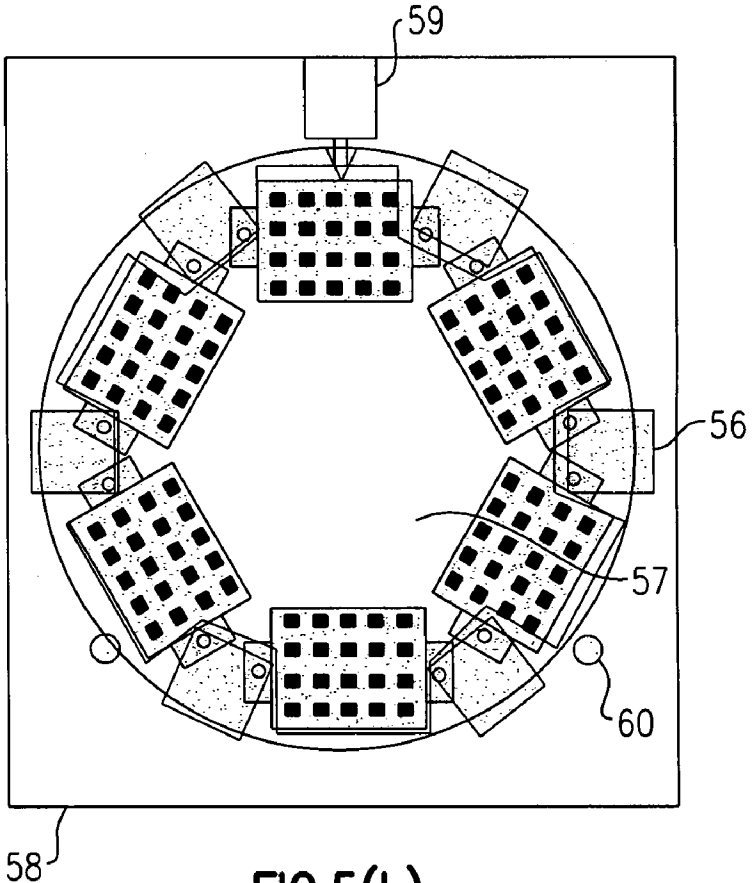
FIG. 5(*a*) (*b*) are diagrams for schematically illustrating a method of positioning the small allocation trays, on which the objects to be ground have been transferred, on the surface of a dividing plate and securing to a fixing jig, in which FIG. 5(*a*) shows the method of positioning the small allocation trays on the surface of a dividing plate and FIG. 5(*b*) shows the method of securing to the fixing jig.
Figure 5A:
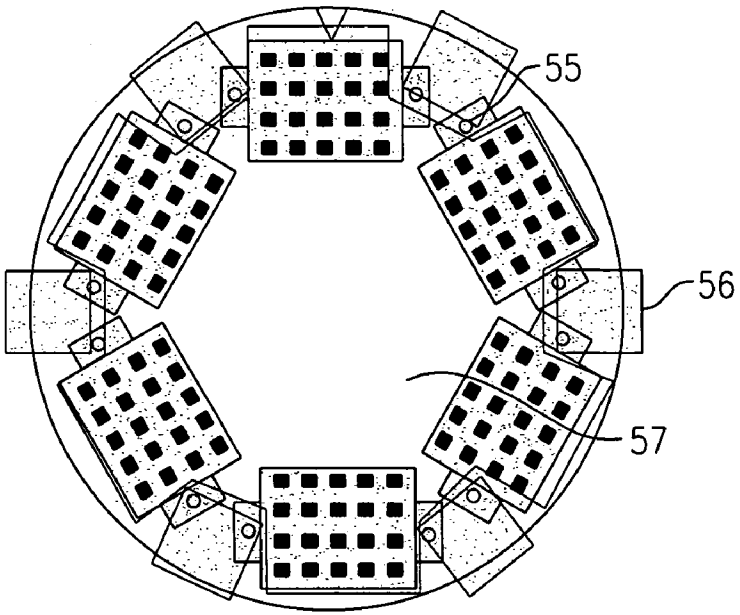

As shown in FIG. 5(*a*), the dividing plate 3 and the small allocation tray 1 are preferably provided with a third positioning means (a third positioning pin or hole) 55 for determining mutual positions when the small allocation trays 1 are arranged on the surface of the dividing plate 3. After positioning, it is preferable to secure the small allocation trays 1 using six second clips 56 and to cover the surface using the second cover 57. As shown in FIG. 5(*b*), after positioning the dividing plate 3 and the small allocation trays 1, the dividing plate 3 in which the small allocation trays 1 have been arranged is preferably secured to the fixture 58 which has a positioning pin 59 with a spring and positioning pins 60.

Figure 6B:
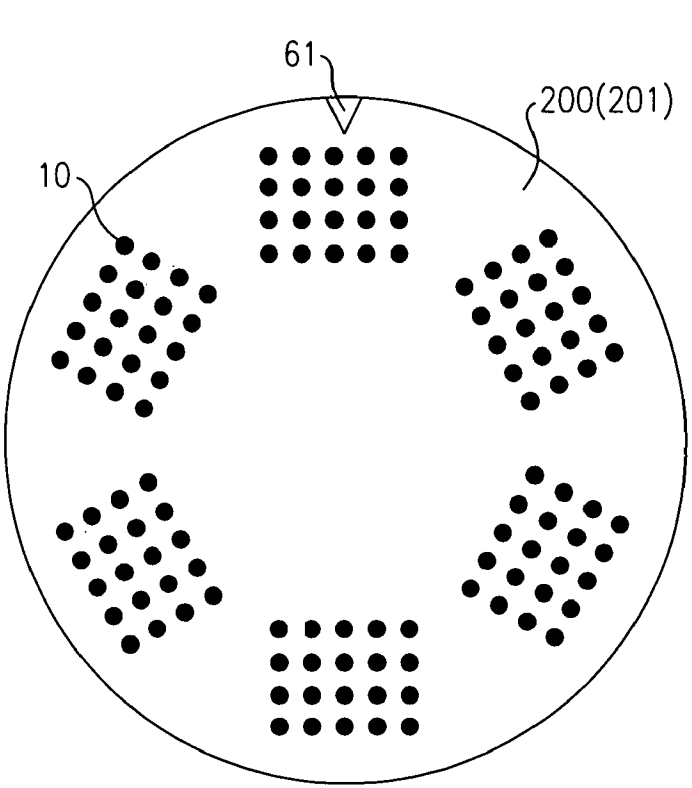
FIG. 6(*a*) (*b*) are diagrams for schematically illustrating a method for locating the objects to be ground, arranged on a small allocation tray 1, on the surface of a grinding jig by superposing thereon in a transferred state, in which FIG. 6(*a*) shows the state before superposing and FIG. 6(*b*) shows the state after superposing.
Figure 6A:
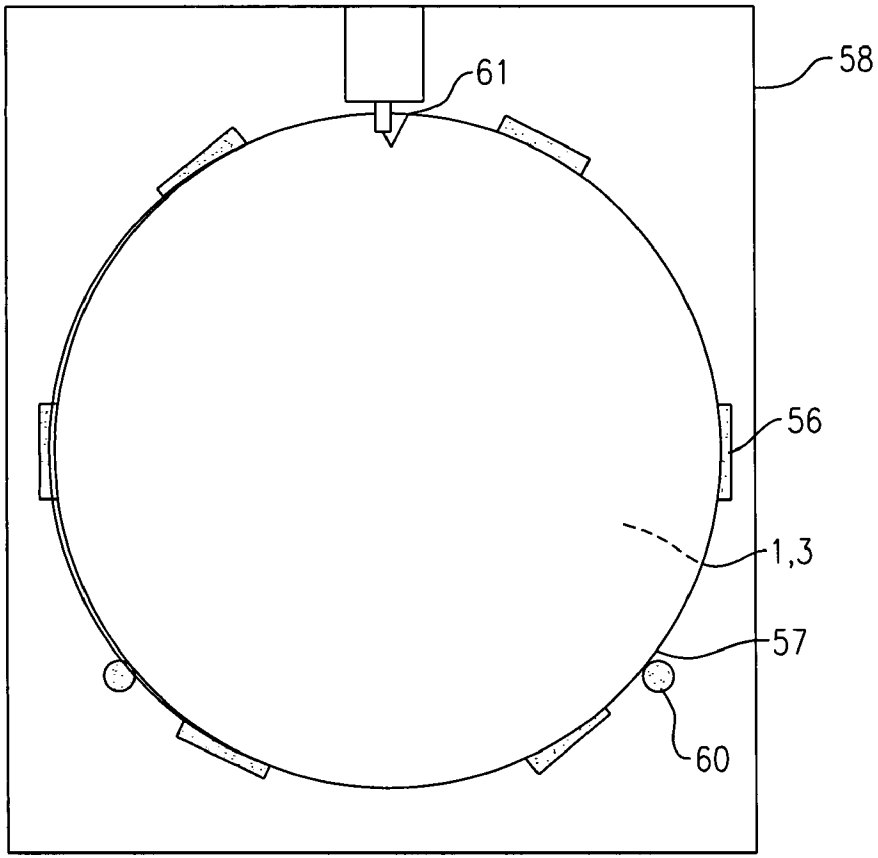

After removing the clips 56 and the second protection cover 57 from the dividing plate 3 in which small allocation trays 1 secured to the fixture 58 have been arranged, as shown in FIG. 6(*a*), the dividing plate 3 is superposed on a grinding jig 200, whereby the objects to be ground 10 in the transfer pockets 11 (see FIG. 1(*a*)) of the small allocation tray 1 are relocated onto the surface of the grinding jig 200 in a transferred state, as shown in FIG. 6(*b*). In this instance, the dividing plate 3 and the grinding jig 200 are preferably provided with a fourth positioning pin (a positioning pin with a spring and a positioning pin) 61 to determine the mutual positions. An adhesive 201 is preferably applied to the surface of the grinding jig 200 in advance. As the adhesive 201, wax and the like can be given for example. In this instance, to firmly secure the objects to be ground 10 to the surface of the grinding jig 200, the objects to be ground 10 are preferably located on the surface of the grinding jig 200 in a manner so that the objects to be ground 10 penetrate the adhesive 201 so that one half or more of their length is embedded in the adhesive 201.

Figures 7A, 7B, 7C:
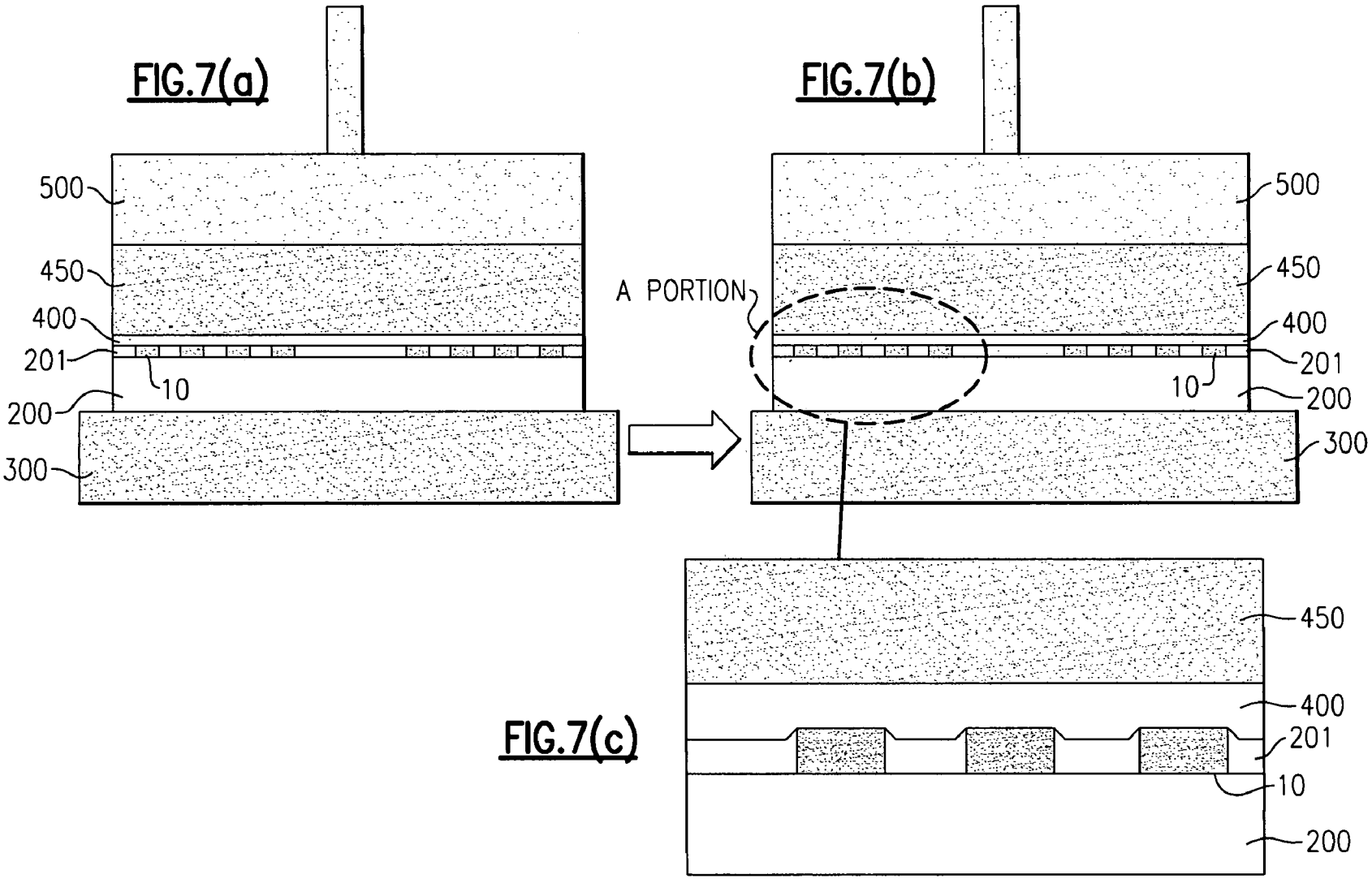
FIG. 7(*a*) (*b*) (*c*) are diagrams for schematically illustrating a method of a press operation after the objects to be ground, arranged on a small allocation tray 1, have been arranged on the surface of the grinding jig, in which FIG. 7(*a*) shows the state before the press operation, FIG. 7(*b*) shows the state after the press operation, and FIG. 7(*c*) is an enlarged view of the section A in FIG. 7(*b*).

To more firmly secure the objects to be ground 10 to the surface of the grinding jig 200, the grinding jig 200 is preferably squeezed between a hot plate 300 and an elastic body 400, of which the surface has a certain hardness, and a weight 450, as shown in FIG. 7(*a*), and pressed using a press machine 500, with the elastic body 400 being placed on the surface of the adhesive 201, which is applied in advance, and heated. In this manner, the embedding height from the surface of the grinding jig 200 in the adhesive 201 can be reduced and efficient processing of the objects to be ground can be ensured from the start of the processing, while holding the objects to be ground from the side and preventing the adhesive 201 from coming into contact with the surface of the plate during grinding.

There are no specific limitations to the method for grinding the objects to be ground 10 located and secured to the surface of the grinding jig 200. For example, grinding work, lap processing, polish processing, and the like can be given.

Figures 8A, 8B:
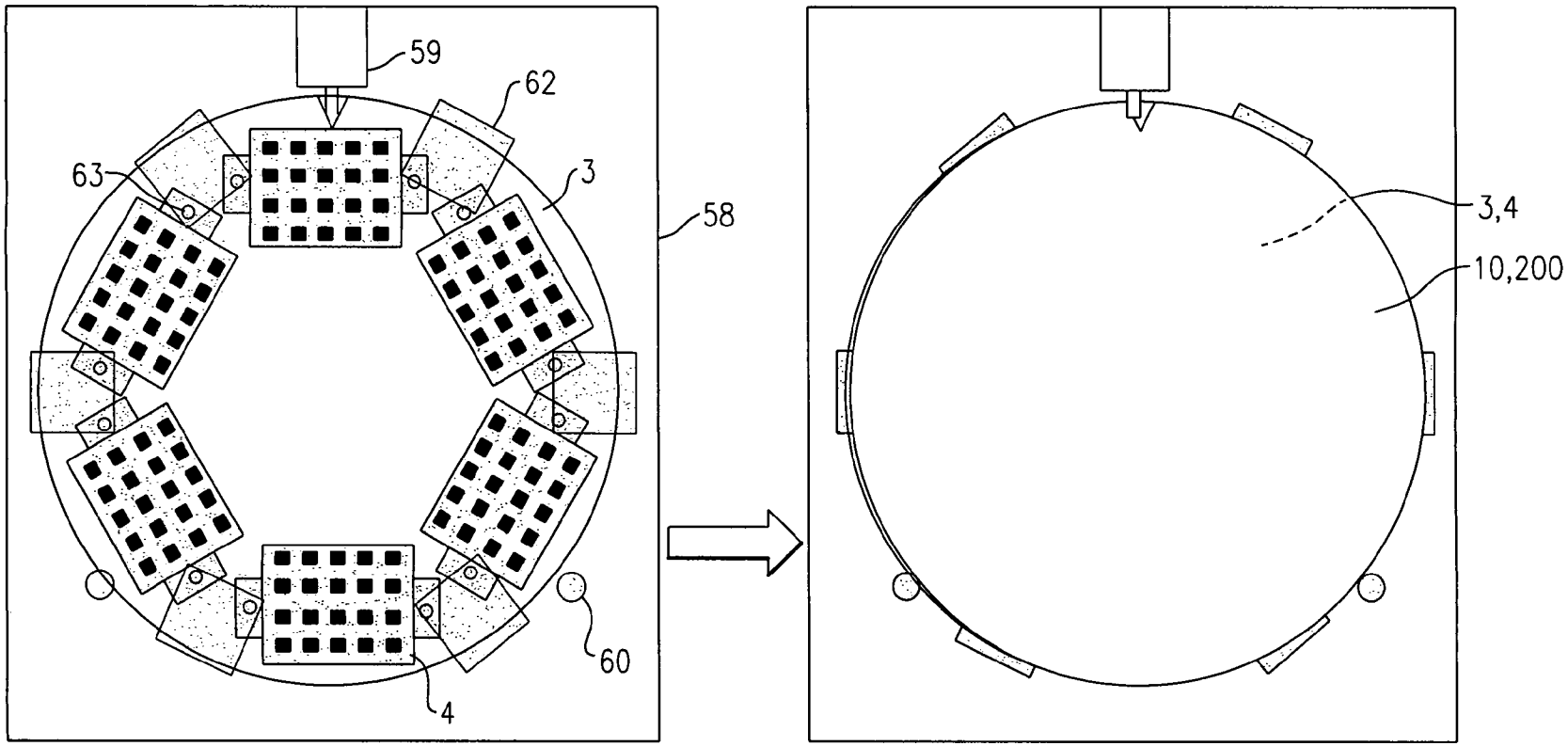
FIG. 8(*a*) (*b*) are diagrams for schematically illustrating a method for arranging small removing trays on the surface of the grinding jig, in which FIG. 8(*a*) shows the state before arrangement and FIG. 8(*b*) shows the state after arrangement.

As shown in FIG. 8(*a*), small removing trays 4 are located on the surface of the dividing plate 3 in an arrangement pattern after the grinding work of the objects to be ground 10, which are located on the grinding jig 200 in the transferred state (see FIG. 6(*b*)). The small removing trays 4 can transfer the ground objects 10 which are removed from the surface of the grinding jig 200 by means of a prescribed process to removing pockets 41 (described later) in the transferred state divided into partial patterns. As the material for the small removing tray 4, a solvent resistant resin is preferable. For example, polyether ether ketone (PEEK) can be mentioned as a suitable example.

To transfer the ground objects 10 divided into partial patterns to the removing pockets 41 of the small removing trays 4, the small removing trays 4 are located on a securing plate 58, which is provided with a positioning pin 59 with a spring and positioning pins 60, in the above-mentioned arrangement pattern on the surface of the dividing plate 3 and secured using third clips 62, as shown in FIG. 8(*a*). In this instance, the dividing plate 3 and the small removing tray 4 are preferably provided with a fifth positioning means (a fourth positioning pin or hole) 63 for determining mutual positions when the small removing trays 4 are arranged on the surface of the dividing plate 3. Then, as shown in FIG. 8(*b*), the grinding jig 200 on which the ground objects 10 are located is superposed on the surface of the dividing plate 3 on which the small removing trays 4 are located in the arrangement pattern. Next, the ground objects 10 removed by a prescribed removing treatment are transferred to the removing pockets 41 in the transferred state divided into partial patterns.

Figures 9A, 9B:
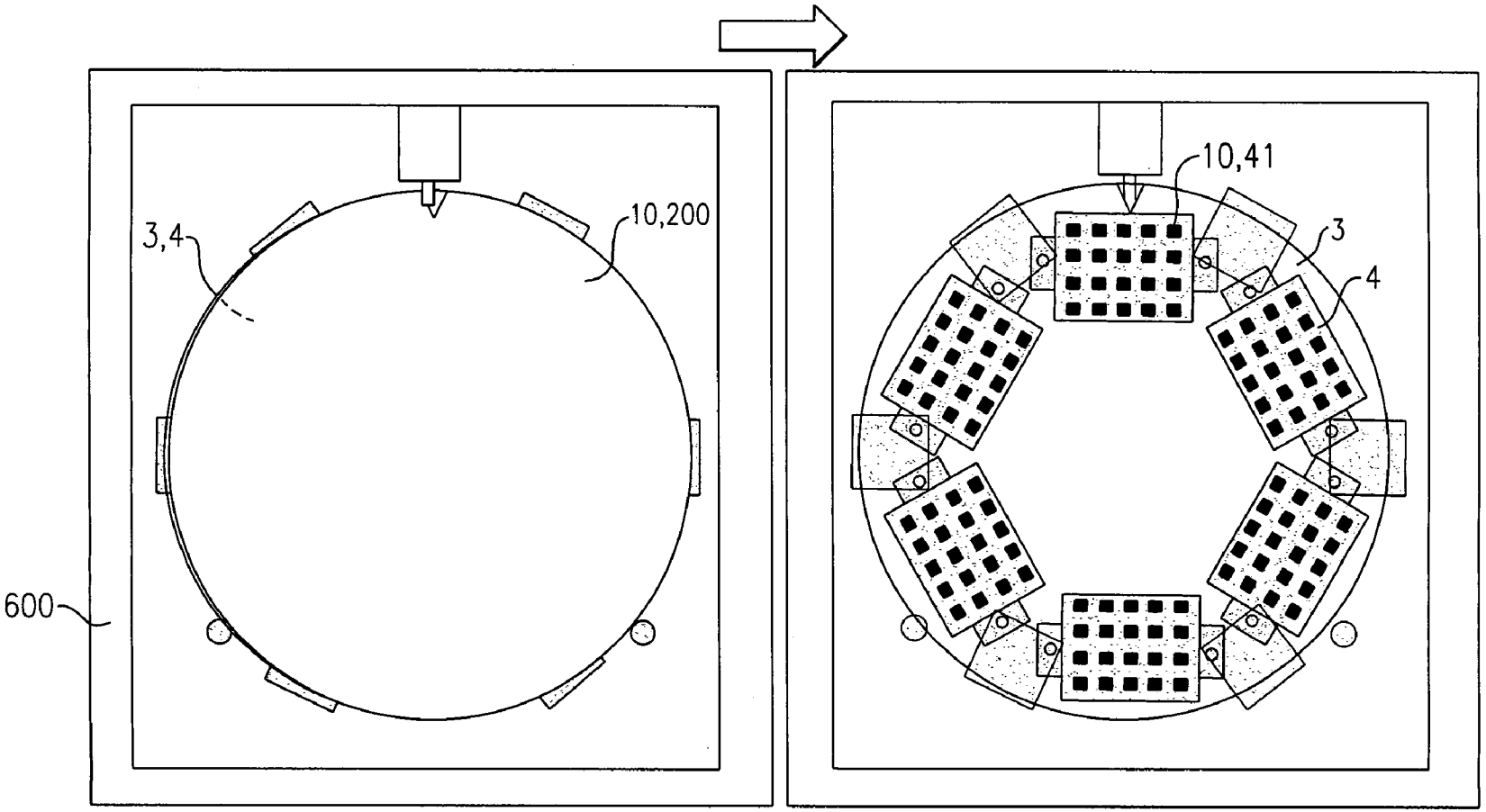
FIG. 9(*a*) (*b*) are diagrams for schematically illustrating a method of transferring the ground objects removed from the grinding jig to the small removing trays which are arranged on the surface of a dividing plate, in which FIG. 9(*a*) shows the state before transfer and FIG. 9(*b*) shows the state after transfer.

The above removing treatment comprises dipping the superposed material of the dividing plate 3 in which the small removing trays 4 are arranged in the arrangement pattern on the surface thereof and the grinding jig 200 in which the ground objects 10 are arranged, as shown in FIG. 9(*a*), in a prescribed removing agent 601, for example, a storage vessel 600 containing isopropyl alcohol, for 1 to 2 hours, removing the ground objects 10 from the grinding jig 200, and transferring the ground objects 10 onto the removing pockets 41 of the small removing tray 4 in the transferred state divided into partial patterns.

The small removing tray 4 is preferably provided with pockets (removing pockets 4) for holding the transferred ground objects 10 and has through-holes (not shown) communicating with the outside formed in the bottom of the removing pocket 41. This configuration ensures that the removing agent 601 is efficiently spread through the through-holes, whereby the ground objects 10 can be efficiently removed from the grinding jig 200.

The small allocation tray 1 and small removing tray 4 are preferably provided with pockets (transfer pockets 11) for holding the transferred ground objects 10, wherein the area of the pockets (removing pockets 41) of the small removing tray 1 is greater than the holding area of the pockets (transfer pockets 11) of the small allocation tray 4. This configuration ensures that the ground objects 10 are covered with the removing pockets 41 when removing the ground objects 10 from the grinding jig 200, whereby it is possible for the removing pockets 41 to hold the ground objects 10 with certainty by effectively preventing the removed ground objects 10 from being damaged due to contact with the jigs.

Figure 10B:
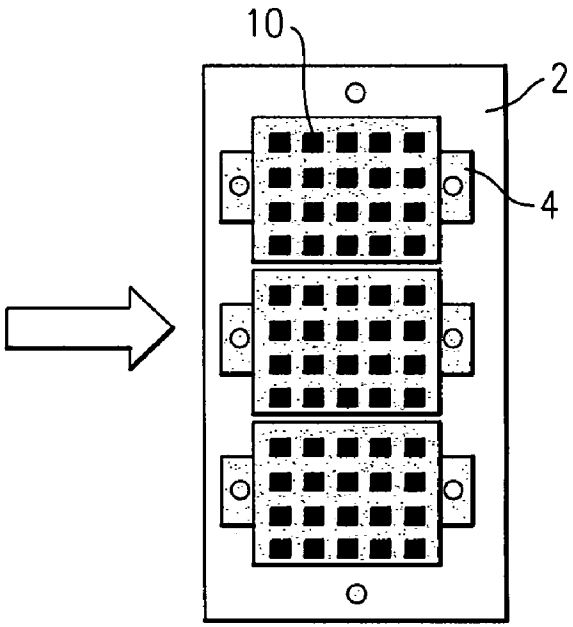
FIG. 10(*a*) (*b*) are diagrams for schematically illustrating a method for arranging small removing trays, onto which the ground objects have been transferred on the surface of the dividing tray, in which FIG. 10(*a*) shows the state before arrangement and FIG. 10(*b*) shows the state after arrangement.
Figure 10A:
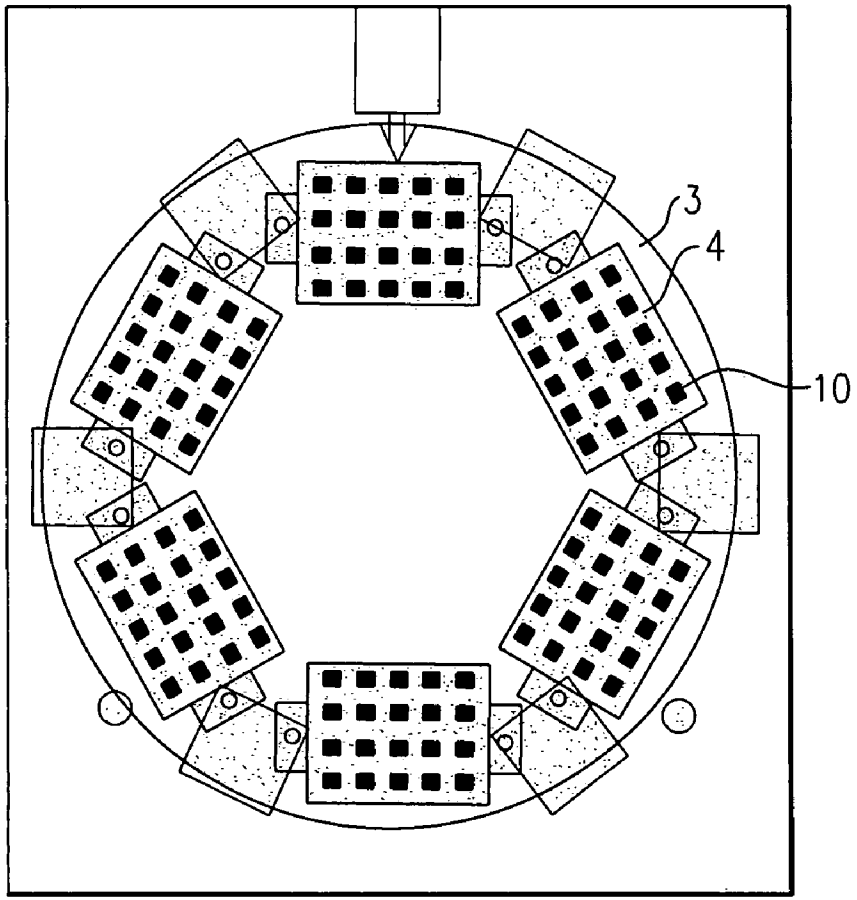

The small removing trays 4 onto which the ground objects 10 have been relocated in the transferred state divided into partial patterns, as shown in FIG. 10(*a*), are removed from the dividing plate 3 and transferred to the dividing tray 2 as shown in FIG. 10(*b*). The methods of positioning and securing described above are applicable to this operation.

Figure 11B:
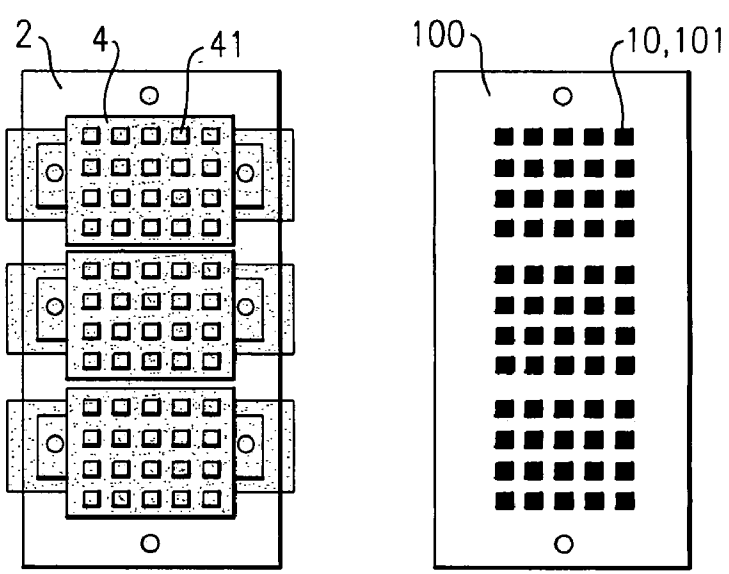
FIG. 11 (*a*) (*b*) are diagrams for schematically illustrating a method for transferring the ground objects from the small removing trays to the small allocation trays, in which FIG. 11(*a*) shows the state before transfer and FIG. 11(*b*) shows the state after transfer.
Figure 11A:
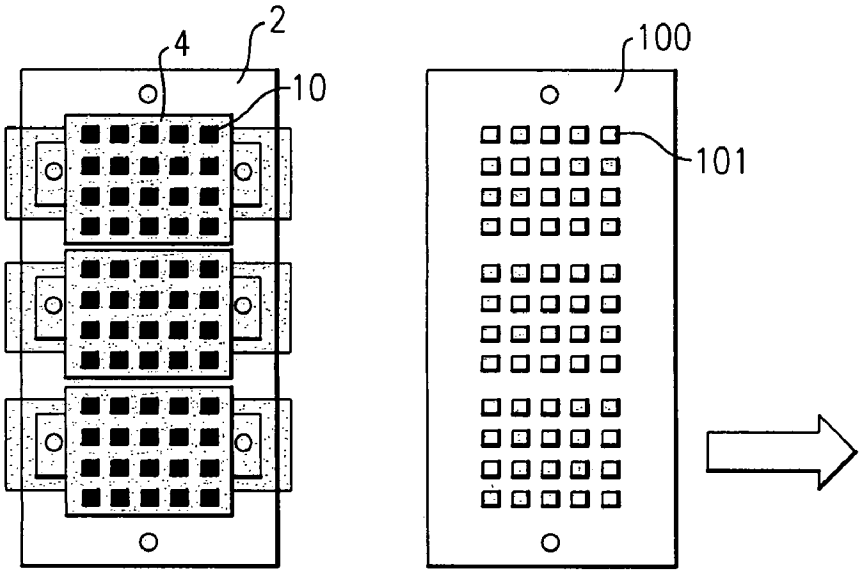

The dividing tray 2 onto which the small removing trays 4 have been transferred is superposed on the starting tray 100 in which the mounting pockets are empty, as shown in FIG. 11(*a*), to obtain the dividing tray 2 on which the small removing trays 4 with empty removing pockets 41 and the starting tray 100 with mounting pockets to which the ground objects 10 have been transferred, as shown in FIG. 11(*b*). A series of processes are completed in this manner. If a removing agent 601 is applied to the surface of the starting tray 100 in advance by, for example, dipping the starting tray 100 in the removing agent 601, generation of bubbles that may be caused by unevenly moistening the surface of the starting tray 100 can be effectively prevented, ensuring transfer of the ground objects without fail.

The grinding method (the first method) of the present invention will now be explained. The above-described grinding jig set can be used in the method.

The grinding method (the first method) of the present invention comprises locating objects to be ground on a grinding jig (a master plate), grinding the objects, and removing the ground objects from the grinding jig after the grinding operation. Specifically, the method comprises providing objects to be ground laid on the surface of a starting tray aligned in a specified pattern, providing small allocation trays on which the objects to be ground can be mounted after receiving transfer thereof from the surface of the starting tray in a state divided in specified partial patterns, providing a dividing tray having a configuration corresponding to the starting tray, placing the small allocation trays on the dividing tray by aligning the small allocation trays in a manner so that the entire pattern made up of the partial patterns may be the mounting pattern, and transferring the objects to be ground from the starting tray to the small allocation trays; transferring the small allocation trays held on the dividing tray to the surface of a dividing plate in a predetermined arrangement pattern; relocating the objects to be ground from the small allocation trays to the surface of the grinding jig in a transferred state to grind the objects transferred onto the surface of the grinding jig in the transferred state; after completion of grinding, removing the ground objects from the surface of the grinding jig by means of a prescribed removing treatment, and relocating the ground objects to the small removing trays located in the arrangement pattern in the transferred state, divided into partial patterns.

When the objects to be ground placed on the small allocation trays are arranged on the surface of the grinding jig in the transferred state, the objects are preferably secured to the surface of the grinding jig in the transferred state using an adhesive. The above-mentioned adhesives can be used.

When an adhesive is previously applied to the surface of the grinding jig and the objects to be ground are secured to that surface with the adhesive in the transferred state, the objects to be ground are preferably secured by a press operation while causing an elastic material with specific hardness to be present on the surface of the adhesive. The above-mentioned elastic materials and press machines can be used.

A small removing tray provided with pockets for holding the objects to be ground having through-holes communicating with the outside formed in the bottom of the pocket is preferably used.

As the small allocation tray and small removing tray, those having pockets for holding the objects to be ground are preferably used. The holding area of the pockets in the small removing tray is preferably larger than the holding area of the pockets in the small allocation tray.

A dividing tray and starting tray are preferably provided with a first positioning means that can determine the mutual positions when the objects to be ground are transferred from the starting tray to the small allocation tray. The above-mentioned first positioning means can be used.

The dividing tray and the small allocation trays are preferably provided with a second positioning means that can determine the mutual positions when the small allocation trays are arranged and retained on the dividing tray. The above-mentioned second positioning means can be used.

A dividing plate and small allocation tray provided with a third positioning means that can determine the mutual positions when the small allocation trays are arranged on the dividing plate are preferably used. The above-mentioned third positioning means can be used.

A dividing plate and small removing tray provided with a fourth positioning means that can determine the mutual positions when the small removing trays are arranged on the dividing plate are preferably used. The above-mentioned fourth positioning means can be used.

The grinding method (the second method) of the present invention will now be explained. The above-described grinding jig set can be used in the method.

The grinding method (the second method) of the present invention comprises locating objects to be ground on a grinding jig (a master plate), grinding the objects, and removing the ground objects from the grinding jig after the grinding operation, in which an adhesive is previously applied to the surface of the grinding jig to secure the objects to be ground to the surface of the grinding jig by positioning them so that they penetrate the adhesive to the extent that one half or more of their length is embedded in the adhesive. The above-mentioned adhesives can be used.

When an adhesive is previously applied to the surface of the grinding jig and the objects to be ground are secured to that surface by positioning them so that the objects penetrate the adhesive to the extent that one half or more of their length is embedded in the adhesive, a press operation is preferably carried out by causing an elastic material with specific hardness to be present on the surface of the adhesive to reduce the embedded height of the objects to be ground in the adhesive. The above-mentioned elastic materials and press machines can be used.

The grinding method (the third method) of the present invention comprises locating objects to be ground on a grinding jig (a master plate), grinding the objects, and removing the ground objects from the grinding jig after the grinding operation, in which an adhesive is previously applied to the surface of the grinding jig to secure the objects to be ground, together with a spot spacer with a thickness greater than the thickness of the objects to be ground, on the surface of the grinding jig by positioning them so that they penetrate the adhesive to the extent that one half or more of their length is embedded in the adhesive.

This configuration ensures that the spot spacer is ground at an early stage of processing to remove foreign matters present between the objects to be ground and the plate and avoids the situation in which only parts of the objects to be ground are caused to come into contact with the plate due to thickness variation, thereby inhibiting excess pressing force from being applied to parts of the objects to be ground.

In this instance, a spot spacer of which the surface or corner coming in contact with the plate is chamfered is preferably used. This configuration effectively prevents only the spot spacer from coming in contact with the plate and damaging the plate at an early stage of the process.

A spot spacer made of ceramics such as zirconia, alumina, or the like is preferably used. Because zirconia or alumina removed by grinding is not ionized, deterioration of the process liquid is effectively prevented. In addition, contamination of the liquid with foreign matters which can be removed only with difficulty in a later stage can be effectively prevented.

The effect of the present invention can be sufficiently exhibited when an object to be ground contains mechanically weak parts.

EXAMPLES

The present invention will be described in more detail by examples. However, the present invention is not limited by these examples.

Example 1

Laminates of ceramics (zirconia, PZT) and metals (gold, platinum) were used as objects to be ground. Each objects to be ground had two U-shaped beam-like projections which may be broken by a small external force. The objects to be ground which were placed in a starting tray beforehand were moved to small allocation trays, transferred to a dividing plate, and then to a grinding jig (a master plate). As the elastic body used for pressing, a silicone rubber sheet with a hardness of 50 and a thickness of 3 mm was used. The embedding length of the adhesive ("Shift Wax" manufactured by Nikka Seiko Co., Ltd.) to the grinding jig was reduced by elastic deformation of 20 μm or more. A grinding allowance of 10 to 15 μm was provided and only the objects to be ground were allowed to come in contact with the plate during grinding. Contact of the adhesive with the plate and process solution was prevented, thereby avoiding a decrease in grinding efficiency due to lack of a grinding fluid or a decrease of a plane pressure to the objects to be ground. A grinding process slurry ("Diamond Slurry" manufacture by Engis Corp., average particle diameter of diamond 0.5 μm), a tin surface plate (manufactured by Lapmaster SFT Corp.), and a grinding machine ("Lapolish 15" manufactured by Lapmaster SFT Corp.) were used. The above combination of the aqueous slurry and adhesive (wax) could successfully preclude the mutual reaction between them and keep diamond dispersion. A load of 900 g was charged to 324 pieces of the objects to be ground with a surface area of 4.5 $mm^2$. When the above method of reducing the height of the adhesive (wax) was adopted, the height of the adhesive (wax) could not be reduced in some areas near the objects to be ground. Although the adhesive (wax) may come into contact with the plate and slurry and be cut during the grinding operation, no problems are caused because the adhesive (wax) was not dissolved in the process fluid. The size of the pocket area of the removing pockets in the small removing tray was 0.4 mm×0.4 mm greater than the pocket area of the transfer pockets in the small allocation tray. This configuration ensured placing the ground objects onto small removing trays without coming in contact with the trays and without being damaged, when mounting the dividing plate with small removing trays mounted thereon after the grinding operation. In the next removing step, after dipping in a solution for one hour, the ground objects were successfully removed from the master plate by ultrasonic treatment.

Example 2

The experiment was carried out in the same manner as in Example 1, except that a spot spacer was installed on the master plate. A spot spacer with an external diameter of 3 mm and a thickness 25 μm greater than the thickness of the objects to be ground was used. To avoid an excess load on the plate at an early stage, a spot spacer of which the surface coming in contact with the plate was chamfered was used. Installation of the spot spacer prevented production of scratches because a brush was not used to remove foreign matter from the objects to be ground, and also precluded damage to the objects to be ground by a brush.

Experiments of Examples 1 and 2 confirmed that removal of 3 μm or more per 10 minutes can be achieved without reducing the process performance and without producing scratches and chipping.

The grinding jig set and the method of grinding of the present invention can be effectively used particularly in the field of manufacturing ceramic electronic parts in which a great number of small objects which contains areas with little toughness must be ground at one time.

What is claimed is:

1. A jig set for grinding comprising a set of jig units used for a series of processing from allocation of objects to be ground on a grinding jig (a master plate) through removing the ground objects from the grinding jig after the grinding operation, wherein the jig units comprise:

small allocation trays capable of mounting objects to be ground thereon divided in specified partial patterns, after receiving transfer thereof from the surface of a starting tray, on which the objects to be ground are aligned in a specified mounting pattern;

a dividing tray having a configuration corresponding to the starting tray, which is capable of holding the small allocation trays previously arranged so that entire aggregation of said partial patterns may be the same as said mounting pattern, when said objects to be ground are transferred to the small allocation trays, and by which said objects to be ground can be transferred from the starting tray to the small allocation trays, while retaining the state of the small allocation trays held therein;

a dividing plate which is capable of having the small allocation trays mounted on the surface thereof in the specified arrangement pattern after receiving transfer of the small allocation trays from the dividing tray in which the small allocation trays are retained, and transferring the objects to be ground laid on the small allocation trays onto the surface of the grinding jig in the transferred state; and small removing trays onto which the ground objects are relocated from the surface of the grinding jig in the transferred state and divided into the above-described partial patterns, after completing the grinding of the objects arranged on the grinding jig in the transferred state and after these objects, which were allocated on the surface of the above-described dividing plate in the above-described allocation patterns, have been removed from the surface of the grinding jig by means of a prescribed removing treatment, the combination of the jig units ensuring that all of the objects to be ground are allocated onto the grinding jig at one time without coming into contact with each other and that the ground objects after completion of the grinding operation are removed from the grinding jig.

2. The jig set according to claim 1, wherein the dividing tray and starting tray are provided with a first positioning means that can determine the mutual positions when the objects to be ground are transferred from the starting tray to the small allocation tray.

3. The jig set according to claim 1, wherein the dividing tray and the small allocation trays are provided with a second positioning means that can determine the mutual positions when the small allocation trays are arranged and retained on the dividing tray.

4. The jig set according to claim 1, wherein the dividing plate and the small allocation tray are provided with a third positioning means that can determine the mutual positions when the small allocation trays are arranged and retained on the dividing plate.

5. The jig set according to claim 1, wherein the dividing plate and the grinding jig are provided with a fourth positioning means that can determine the mutual positions when the objects to be ground laid on the small allocation trays, which are arranged on the surface of the dividing plate, are located on the surface of the grinding jig in a transferred state.

6. The jig set according to claim 1, wherein the dividing plate and the small removing tray are provided with a fifth positioning means that can determine the mutual positions when the small removing trays are arranged on the surface of the dividing plate.

7. The jig set according to claim 1, wherein the small removing tray is provided with pockets for holding the objects to be ground and has through-holes communicating with the outside formed in the bottom of the pockets.

8. The jig set according to claim 1, wherein the small allocation tray and the small removing tray are provided with pockets for holding the objects to be ground and the holding area of the pockets in the small removing tray is larger than the holding area of the pockets in the small allocation tray.

9. A grinding method comprising locating objects to be ground on a grinding jig (a master plate), grinding the objects, and removing the ground objects from the grinding jig after grinding operation, the method further comprising:

providing objects to be ground laid on the surface of a starting tray aligned in a specified pattern, providing small allocation trays which can mount the objects to be ground thereon after receiving transfer thereof from the surface of the starting tray in a state divided in specified partial patterns, providing a dividing tray having a configuration corresponding to the starting tray, placing the small allocation trays on the dividing tray by aligning the small allocation trays in a manner so that the entire pattern aggregating the partial patterns may be the mounting pattern, and transferring the objects to be ground from the starting tray to the small allocation trays;

transferring the small allocation trays held on the dividing tray to the surface of a dividing plate in a predetermined arrangement pattern;

relocating the objects to be ground from the small allocation trays to the surface of the grinding jig in a transferred state in order to grind the objects relocated onto the surface of the grinding jig in the transferred state; and after completion of the grinding, removing the ground objects from the surface of the grinding jig by means of a prescribed removing treatment, and transferring the ground objects to the small removing trays located in the arrangement pattern in the transferred state, divided into the partial patterns.

10. The method according to claim 9, wherein when the objects to be ground placed on the small allocation trays are arranged on the surface of the grinding jig in a transferred state, the objects to be ground are secured on the surface of the grinding jig in the transferred state using an adhesive.

11. The method according to claim 10, wherein when an adhesive is previously applied to the surface of the grinding jig and the objects to be ground are secured to that surface with the adhesive in the transferred state, the objects to be ground are secured by a press operation while causing an elastic material with specific hardness to be present on the surface of the adhesive.

12. The method according to claim 9, wherein the small removing tray is provided with pockets for holding the objects to be ground and has through-holes communicating with the outside formed in the bottom of the pockets.

13. The method according to claim 9, wherein a small allocation tray and small removing tray having pockets for holding the objects to be ground are used and the holding area of the pockets in the small removing tray is larger than the holding area of the pockets in the small allocation tray.

14. The method according to claim 9, wherein the dividing tray and starting tray are provided with a first positioning means that can determine the mutual positions when the objects to be ground are transferred from the starting tray to the small allocation tray.

15. The method according to claim 9, wherein the dividing tray and the small allocation tray are provided with a second positioning means that can determine the mutual positions when the small allocation trays are arranged and retained on the dividing tray.

16. The method according to claim 9, wherein the dividing plate and the small allocation tray are provided with a third positioning means that can determine the mutual positions when the small allocation trays are arranged on the surface of the dividing plate.

17. The method according to claim 9, wherein the dividing plate and the small removing tray are provided with a fourth positioning means that can determine the mutual positions when the small removing trays are arranged on the surface of the dividing plate.

* * * * *